US006883177B1

(12) United States Patent
Ouellette et al.

(10) Patent No.: US 6,883,177 B1
(45) Date of Patent: Apr. 26, 2005

(54) PORTABLE KNEEPAD

(76) Inventors: Daniel Ouellette, 61 Zuella Dr. Unit #6, Waterbury, CT (US) 06704; Richard Ricci, 686 Northfield Rd., North Field, CT (US) 06778

( * ) Notice: Subject to any disclaimer, the term of this patent is extended or adjusted under 35 U.S.C. 154(b) by 420 days.

(21) Appl. No.: 10/144,270

(22) Filed: May 13, 2002

(51) Int. Cl.[7] ..... A41D 13/06
(52) U.S. Cl. ..... 2/24
(58) Field of Search ..... 602/5, 6, 15, 17–22, 602/23–30; 248/346.01, 346.03, 346.05; 297/423.1, 423.11, 423.14, 423.16, 423.17, 423.39–423.42; 128/112.1, 113.1, 117.1–126.1, 845, 846, 857, 858, 882, 115.1; 2/24, 22, 23, 16, 17–21, 456, 62, 267, 268, 92, 463, 464, 465–467; 5/600, 620, 621, 623, 624, 648, 655.9

(56) References Cited

U.S. PATENT DOCUMENTS 2,195,817 A * 4/1940 Johnson ..... 2/24
2,641,793 A * 6/1953 Wilm ..... 16/435
2,760,788 A * 8/1956 Segall ..... 280/752
2,905,946 A * 9/1959 Goldsmith ..... 2/158
3,938,614 A * 2/1976 Ahs ..... 181/129
4,006,900 A * 2/1977 DiVito ..... 473/457
4,723,322 A * 2/1988 Shelby ..... 2/24
4,748,975 A * 6/1988 Yashima ..... 602/60
5,090,055 A * 2/1992 McElroy ..... 2/24
5,195,197 A * 3/1993 Gutierrez et al. ..... 5/500
5,524,292 A * 6/1996 Hargens ..... 2/24
5,642,739 A * 7/1997 Fareed ..... 128/881
5,720,046 A * 2/1998 Lopez et al. ..... 2/159
5,733,011 A * 3/1998 Young et al. ..... 297/423.11
6,079,067 A * 6/2000 Becker et al. ..... 5/655
6,182,313 B1 * 2/2001 Eschenbach ..... 5/640
6,454,357 B1 * 9/2002 Foulger ..... 297/423.41

* cited by examiner

*Primary Examiner*—A. Vanatta

(57) ABSTRACT

The portable kneepad is comprised of a cushion that has a knee-shaped indentation designed to comfortably support a user's knee. On the bottom side of the cushion is a magnet that allows the kneepad to hand from a metal surface when not in use and a handle means on the outer part of the cushion which allows the kneepad to be carried to various locations for its use. A gripping tread on the bottom side of the kneepad prevents the kneepad from moving or sliding when in use. The cushion is either made of rubber or polyurethane and/or has a waterproof and oil-resistant cover and allows automobile mechanics to use the kneepad to comfortably kneel while loading an automobile lift and to store the kneepad out of the way when not in use.

15 Claims, 2 Drawing Sheets

PORTABLE KNEEPAD

BACKGROUND OF THE INVENTION

1. Field of the Invention

The present invention relates to a portable knee for use in connection with but not limited to setting up and using a standard automobile lift. The portable kneepad has particular utility in connection with providing the user, such as an automobile mechanic or technician, with a comfortable, oil-resistant kneeling cushion that may be conveniently moved for use with a handle and magnetically stored on an automobile lift or other metal surface when not in use.

2. Description of the Prior Art

Portable kneepads are desirable for providing automobile mechanics with a comfortable, oil-resistant kneeling cushion when setting up and using an automobile lift, and for conveniently moving the kneeling cushion for use with a handle and magnetically storing the kneeling cushion on the automobile lift when not in use.

The use of kneepads is known in the prior art. For example, U.S. Pat. No. 5,090,055 to McElroy discloses an air cushion kneeling pad. However, the McElroy '055 patent does not provide for a magnetic means for storing the invention against a metal object or surface, and has further drawbacks of having transverse bars that creates two cavities and thereby lessens the convenience and comfort of the kneepad.

U.S. Pat. No. 5,524,292 to Hargens discloses a kneepad unit that has an outer plastic shell and a plurality of pneumatic tubes that are attached within the shell. However, the Hargens '292 patent does not allow for a firm, stable position on an oily or wet surface given the inventions curved configuration, and additionally does not provide for a magnetic means for storing the invention against a metal object or surface Similarly, U.S. Pat. No. 5,865,507 to Earl discloses a kneeler that that has a rectangular base with a pair of coextensive troughs having knee wells. However, the Earl '507 patent does not have a magnetic means for storing the invention against a metal object or surface and provides for a seating area and dual knee wells which adds to its bulk and inconvenience in use and in storage.

Lastly, U.S. Pat. No. 5,733,011 to Young discloses a multiple position tool caddy seat that has a base of at least two rest surfaces to support a user in a kneeling position. However, the Young '011 patent does not offer a simple yet comfortable single cushion that is waterproof and oil resistant and further has a gripping tread for added stability, and has the additional deficiency of failing to provide for a magnetic means for storing the invention against a metal object or surface.

While the above-described devices fulfill their respective, particular objectives and requirements, the aforementioned patents do not describe a portable kneepad that allows a user, such as an automobile mechanic, to have a comfortable, oil-resistant kneeling cushion that may be conveniently moved for use with a handle and may further be magnetically stored on an automobile lift or other metal surface when not in use. The above mentioned patents and other kneepads known in the art makes no provision for a magnetic coupling means positioned within the padded cushion of the portable kneepad for allowing the kneepad to be stored against metal objects or a metal surface while still allowing easy access thereto.

Therefore, a need exists for a new and improved portable kneepad that can be used for providing a user, such as an automobile mechanic, with a comfortable, oil-resistant kneeling cushion that may be conveniently moved for use with a handle and magnetically stored on an automobile lift or other metal surface when not in use. In this regard, the present invention substantially fulfills this need. In this respect, the portable kneepad according to the present invention substantially departs from the conventional concepts and designs of the prior art, and in doing so provides an apparatus primarily developed for the purpose of providing a user, such as an automobile mechanic or technician, with a comfortable, oil-resistant kneeling cushion that may be conveniently moved for use with a handle and magnetically stored on an automobile lift or other metal surface when not in use.

SUMMARY OF THE INVENTION

In view of the foregoing disadvantages inherent in the known types of kneepads now present in the prior art, the present invention provides an improved portable kneepad, and overcomes the above-mentioned disadvantages and drawbacks of the prior art. As such, the general purpose of the present invention, which will be described subsequently in greater detail, is to provide a new and improved portable kneepad which has all the advantages of the prior art mentioned heretofore and many novel features that result in a portable kneepad which is not anticipated, rendered obvious, suggested, or even implied by the prior art, either alone or in any combination thereof.

To attain this, the present invention essentially comprises a portable kneepad having a padded cushion with a magnetic means incorporated into the bottom side of the padded cushion. The padded cushion is generally has a square-shaped with a rounded front edge and a rounded indentation for resting a knee when the user is in a kneeling position. A gripping tread is attached to the exterior bottom of the padded cushion to prevent the portable kneepad from slipping when in use. Incorporated into the bottom of the padded cushion is a magnetic means, which may be a rounded, disc-like magnet that allows the portable kneepad to be stored on a metal surface when not in use. Additionally, padded cushion may be made of molded foam and/or an oil-resistant and/or waterproof material.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable kneepad that has all of the advantages of the prior art kneepads and none of the disadvantages.

It is another object of the present invention to provide a new and improved portable kneepad that may be easily and efficiently manufactured and marketed.

An even further object of the present invention is to provide a new and improved portable kneepad that has a low cost of manufacture with regard to both materials and labor, and which accordingly is then susceptible of low prices of sale to the consuming public, thereby making such portable kneepad economically available to the buying public.

Still another object of the present invention is to provide a new portable kneepad that provides in the apparatuses and methods of the prior art some of the advantages thereof, while simultaneously overcoming some of the disadvantages normally associated therewith.

Even still another object of the present invention is to provide a portable kneepad for providing a user, such as an automobile mechanic, with a comfortable, oil-resistant kneepad. This allows the user to comfortably kneel while setting up and using an automobile lift.

Still yet another object of the present invention is to provide a portable kneepad that offers a handle and magnetic storing means. This makes it possible to conveniently carry or transport the portable kneepad to various locations for use and to store the kneepad on a metal surface when not in use.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when considered is given to the following detailed description thereof. Such description makes reference to the annexed drawings wherein.

The same reference numerals refer to the same parts throughout the various figures.

DESCRIPTION OF THE CURRENT EMBODIMENT

Figure 1:
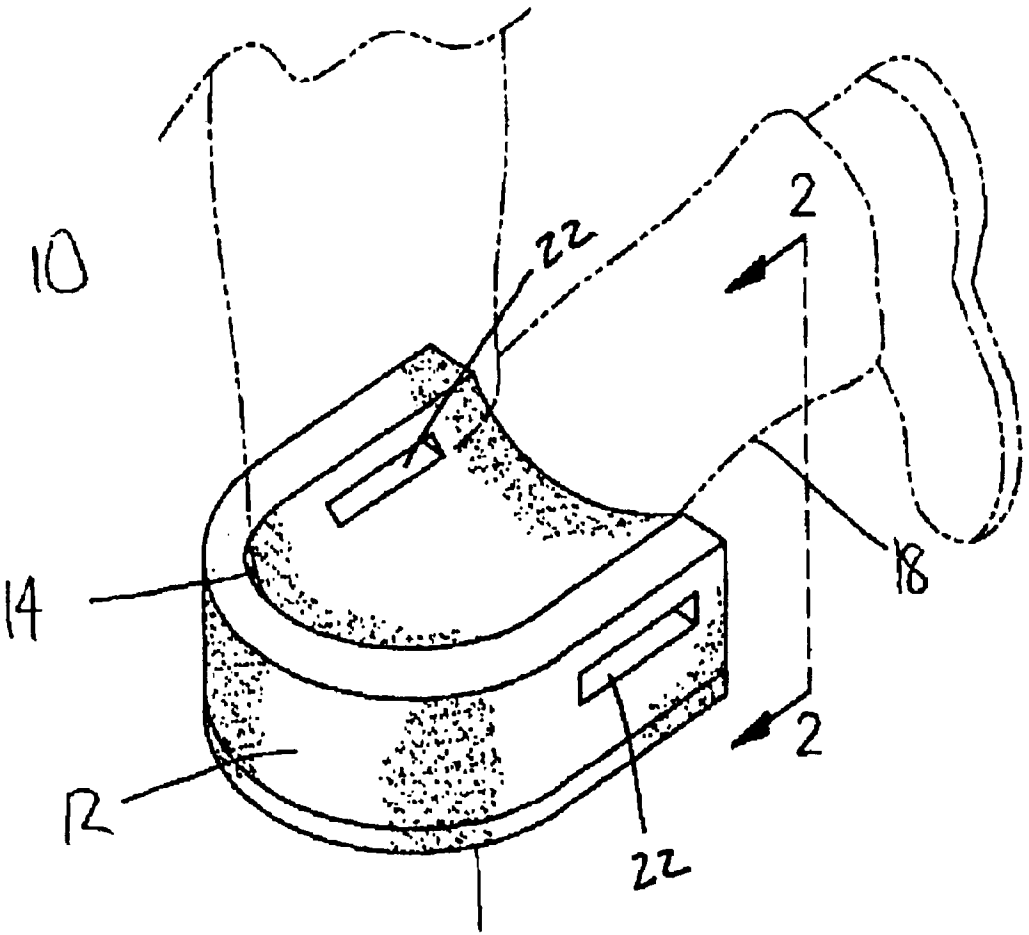
FIG. 1 is a front perspective view of the current embodiment of the portable kneepad constructed in accordance with the principles of the present invention.

Referring now to the drawings, and particularly to FIGS. 1–3*a* current embodiment of the portable kneepad of the present invention is shown and generally designated by the reference numeral 10.

In FIG. 1, a new and improved portable kneepad 10 of the present invention for providing a user, such as an automobile mechanic, with a comfortable, oil-resistant kneeling cushion that may be conveniently moved for use with a handle 22 and magnetically stored on an automobile lift or other metal surface when not in use is illustrated and will be described. More particularly, the portable kneepad 10 has a padded cushion 12 that is generally oil and waterproof and square in shape while having a rounded front edge and a rounded indentation 14 situated toward the center and back of the padded cushion 12. A gripping tread 16 is present on the bottom of the padded cushion 12 in order to prevent the portable kneepad from slipping. When in use, a person in a kneeling position places a knee 18 in the rounded indentation 14 which provides for a padded and comfortable support means. Slots in the opposing sides of padded cushion 12 form handles 22.

Figure 2:
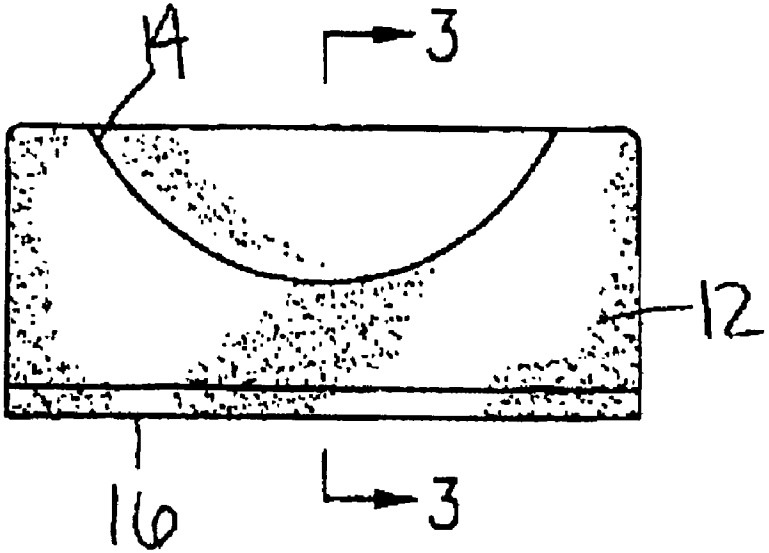
FIG. 2 is a rear elevational view of the portable kneepad of the present invention.

FIG. 2 shows a front perspective of the portable kneepad. The padded cushion 12 has a rounded front edge and a rounded indentation 14 onto which a knee of a user in a kneeling position may comfortably be placed. A gripping tread 16 is present on the bottom of the padded cushion 12 in order to prevent the portable kneepad from slipping.

Figure 3:
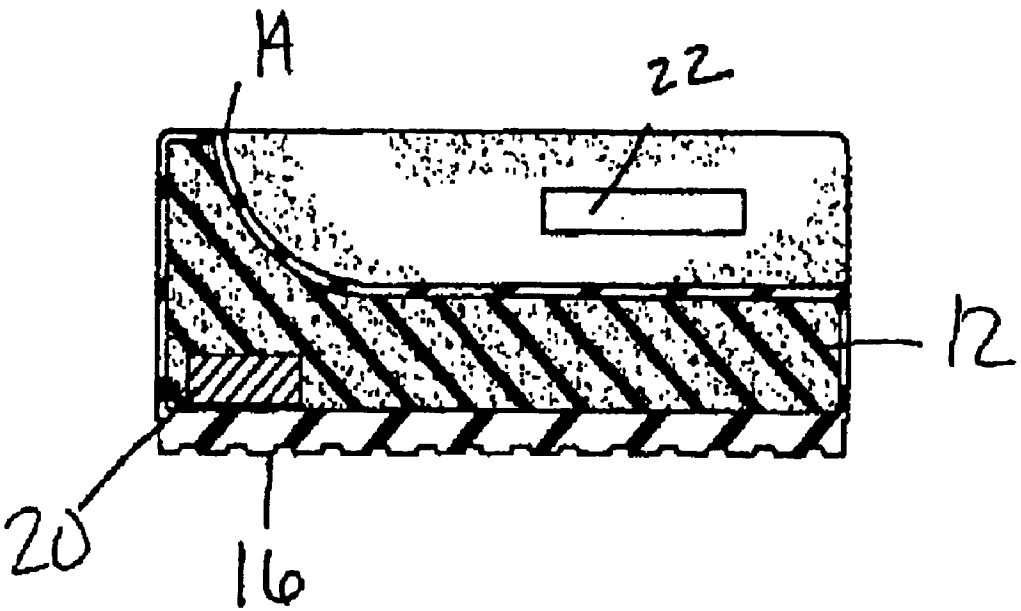
FIG. 3 is a side cross-sectional view of the portable kneepad of the present invention.

In FIG. 3, a side view of the invention is shown and depicts the padded cushion 12 that has a generally square shape and a rounded indentation 14 onto which a knee of a user in a kneeling position may comfortably be placed. A gripping tread 16 is present on the bottom of the padded cushion 12 in order to prevent the portable kneepad from slipping. Also present on the bottom of the padded cushion 12 is a magnetic means 20 which may be incorporated into or affixed to the bottom of the padded cushion and thereby allows the portable kneepad to be stored against a metal surface for convenient access. Handles 22 are visible in the opposing sides of padded cushion 12.

The portable kneepad is generally a comfort-enhancing accessory to be used by automobile mechanics and technicians formed by a square foam oil and water resistant cushion with a rounded front edge while the center and rear top portion of the cushion has a rounded indentation for a user's knee. Additionally, the portable kneepad has a handle on its exterior that allows it to be carried to various locations as well as a magnetic coupling means positioned within the cushion which permits the portable kneepad to be stored against a metal surface while still allowing easy access thereto. A gripping tread is present on the bottom of the kneepad in order to prevent the kneepad from slipping while being used.

In use, it can now be understood that in use an automobile mechanic may use the portable kneepad for kneeling when setting up and using an automobile lift and may conveniently carry the portable kneepad using a handle on its exterior and magnetically store the portable kneepad on the automobile lift when not in use.

While a current embodiment of the portable kneepad has been described in detail, it should be apparent that modifications and variations thereto are possible, all of which fall within the spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable material such as foam, rubber, or other padded, comfortable material may be used for the padded cushion described. Also, the magnetic means may be any type of magnet or material having magnetic qualities may be used instead of the round disc-like magnet described. And although providing a user, such as an automobile mechanic, with a comfortable, oil-resistant kneeling cushion that may be conveniently moved for use with a handle and magnetically stored on an automobile lift or other metal surface when not in use has been described, it should be appreciated that the portable kneepad herein described is also suitable for kneeling in a wide variety of instances such as cleaning, repairing various equipment or appliances and other activities that require the user to be in a kneeling position. Furthermore, a wide variety of sturdy, gripping materials or rubber may be used instead of the tread described. The portable kneepad may also be made of a wide variety of colors and shapes and sizes and be made of a wide variety of waterproof and oil proof materials, and the padded cushion may further have a protective coating such as polyurethane, neoprene or the like.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable kneepad comprising:

a padded cushion having an interior, an exterior, a top side, a bottom side, a front edge, a rear edge, and opposing sides;

a magnetic means incorporated into said bottom side of said padded cushion;

a rounded indentation on said top side of said padded cushion forming a support cradle for a knee; and a handle, wherein at least one of said opposing sides of said padded cushion defines a slot therein to comprise said handle.

2. The portable kneepad of claim 1 further comprising a gripping tread attached to said exterior of said bottom side of said padded cushion.

3. The portable kneepad of claim 1 wherein said padded cushion is square-shaped and said front edge is rounded.

4. The portable kneepad of claim 1 wherein said padded cushion is selected from the group consisting of foam and rubber.

5. The portable kneepad of claim 1 wherein said magnetic means is incorporated into said interior of said padded cushion.

6. The portable kneepad of claim 1 wherein said magnetic means is a round disc-shaped magnet.

7. The portable kneepad of claim 1 wherein said padded cushion has an oil-resistant and waterproof material covering.

8. The portable kneepad of claim 2 wherein said gripping tread is made of rubber.

9. The portable kneepad of claim 1 wherein said front edge of said padded cushion is rounded.

10. A portable kneepad comprising:

a padded cushion having an interior, an exterior, a top side, a bottom side, a rounded front edge, a rear edge, and opposing sides wherein said padded cushion is generally square-shaped;

a magnetic means incorporated into said bottom side of said padded cushion;

a rounded indentation on said top side of said padded cushion;

a handle, wherein at least one of said opposing sides of said padded cushion defines a slot therein to comprise said handle; and a gripping tread attached to said exterior of said bottom side of said padded cushion.

11. The portable kneepad of claim 10 wherein said magnetic means is incorporated into said interior of said padded cushion.

12. The portable kneepad of claim 10 wherein said magnetic means is a round disc-shaped magnet.

13. The portable kneepad of claim 10 wherein said padded cushion further comprises an oil-resistant and waterproof covering.

14. A portable kneepad comprising a padded cushion having an interior, an exterior, a top side, a bottom side, a front edge, a rear edge, and opposing sides wherein said front edge is rounded;

a round disc-shaped magnet attached to said front edge of said padded cushion;

a rounded indentation on said top side of said padded cushion;

a plurality of handles, wherein said opposing sides of said padded cushion define a slot therein to comprise said handles; and a gripping tread attached to said exterior of said bottom side of said padded cushion.

15. The portable kneepad of claim 14 wherein said padded cushion further comprises an oil-resistant and waterproof covering.

* * * * *